United States Patent [19]

Noel et al.

[11] Patent Number: 4,777,467

[45] Date of Patent: Oct. 11, 1988

[54] HIGH DENSITY RESISTOR ARRAY

[75] Inventors: Donald N. Noel, Lake Worth; Glenn F. Wolfe, Plantation, both of Fla.

[73] Assignee: Harris Corporation, Melbourne, Fla.

[21] Appl. No.: 69,808

[22] Filed: Jul. 6, 1987

[51] Int. Cl.[4] ..... H01C 1/012

[52] U.S. Cl. ..... 338/308; 338/333

[58] Field of Search ..... 338/308, 252, 195, 333, 338/307, 309, 306; 29/610, 620 R

[56] References Cited

U.S. PATENT DOCUMENTS

| | | | |
|---|---|---|---|
| 3,657,692 | 4/1972 | Wormser | 338/252 |
| 3,665,599 | 5/1972 | Herczog et al. | 29/620 |
| 3,947,801 | 3/1976 | Bube | 338/308 |

*Primary Examiner*—E. A. Goldberg
*Assistant Examiner*—M. M. Lateef
*Attorney, Agent, or Firm*—Joel I. Rosenblatt

[57] ABSTRACT

A high density resistor array mounted on a substrate is used in a balanced array. Each circuit element in the array is terminated with a resistor and with each terminating resistor being located at a uniform electrical and physical distance from its respective circuit, resulting in uniform impedances.

20 Claims, 2 Drawing Sheets

HIGH DENSITY RESISTOR ARRAY

FIELD OF THE INVENTION

This invention relates to a high density pin grid array, such as used in emittor coupled logic (ecl) and which is connected through a terminating resistor to a plane, such as a printed circuit board.

BACKGROUND OF THE INVENTION

High density pin grid arrays, requiring uniform impedance through terminating resistors have been built using a buried resistor configuration. This means that the circuit elements, such as emitter coupled logic circuit elements, are connected to a circuit board by means of a pin connection from the circuit element to a conductive element on the board. The circuit element is connected to the interior of the board where the terminating resistor is located. This resistor then terminates the circuit element on the plane of the board. As the densities of the circuit elements increased, decreasing the interpin distance, the room available for the terminating resistors decreased, forcing some resistors to be located outside the array and to be connected by a stub. However, as the terminating resistor was located outside the array, the length of the stub introduced an imbalance, and where the stubs to the various terminating resistors were of different lengths, the electrical imbalances introduced by the stub of various lengths were compounded.

SUMMARY OF THE INVENTION

The invention disclosed in this application is a high density resistor board array for connecting circuit elements through a respective terminating resistor to substrate such as a terminating surface or plane on a circuit board. In balanced arrays, such as in emitter coupled logic (ecl) arrays, the electrical impedance of all the networks comprising such circuit elements, must be matched. Further, the resistor used to terminate each respective circuit element must be sufficiently thermally isolated from the pin connection of that circuit element to the board, so no damage rsults to the resistor during the pin soldering process. Accordingly, this invention provides a means of connecting an array of circuit elements to a substrate mounted terminating plane, such as a circuit board surface serving as a terminating plane, with each terminating resistor being located at a uniform electrical and physical distance from its respective circuit element pin connection to the terminating plane. The terminating plane is shown by way of example only and should not be thought of as limiting the principles of the invention.

According to the preferred embodiment of the invention, a copper resistive layer is mounted on a substrate. Within the copper surface is a set of non-conductive areas. The non-conductive areas, according to the preferred embodiment, are uniform and located on uniform center distances from each other. Within each non-conductive area is a conductive surface with a means for electrically receiving a connecting pin for example, from a circuit element. The connecting pin in the preferred embodiment is a conductor such as copper. The conductive surface, according to the preferred embodiment, is of a geometric shape having a defined perimeter. A conductive leg is connected at a point on the perimeter with the connection being sufficiently small to reduce the amount of heat transfer from the pin and the conductive surface through the leg. A terminating resistor is processed by removing part of the conductive area and depositing resistive material within each of the non-conductive areas on the substrate surface. The resistor is connected to the terminating plane at one end. At the other end, the resistor is connected to the conductive surface through the conductive leg. The leg connection is located within the non-conductive area, and is isolated, except for its point of connection to the plane and to the resistor. The leg connection is elongated relative to its point connection to the conductive surface, reducing heat conductivity through to the resistor. The conductive surface, the connecting leg, and resistor are all located in the same positions relative to each non-conductive area thereby establishing a uniform electrical distance from the circuit element pin connection to the groundng surface, and establishing a uniform circuit impedance. The array may be arranged on 100 mil. centers, according to the preferred embodiment thereby resulting in a highly packed dense array with uniform terminating impedance and with all of the circuit elements located on a single substrate.

Further details of the invention, according to the preferred embodiment, is as shown below in detailed description of the invention.

DESCRIPTION OF THE PREFERRED EMBODIMENT

Figure 1:
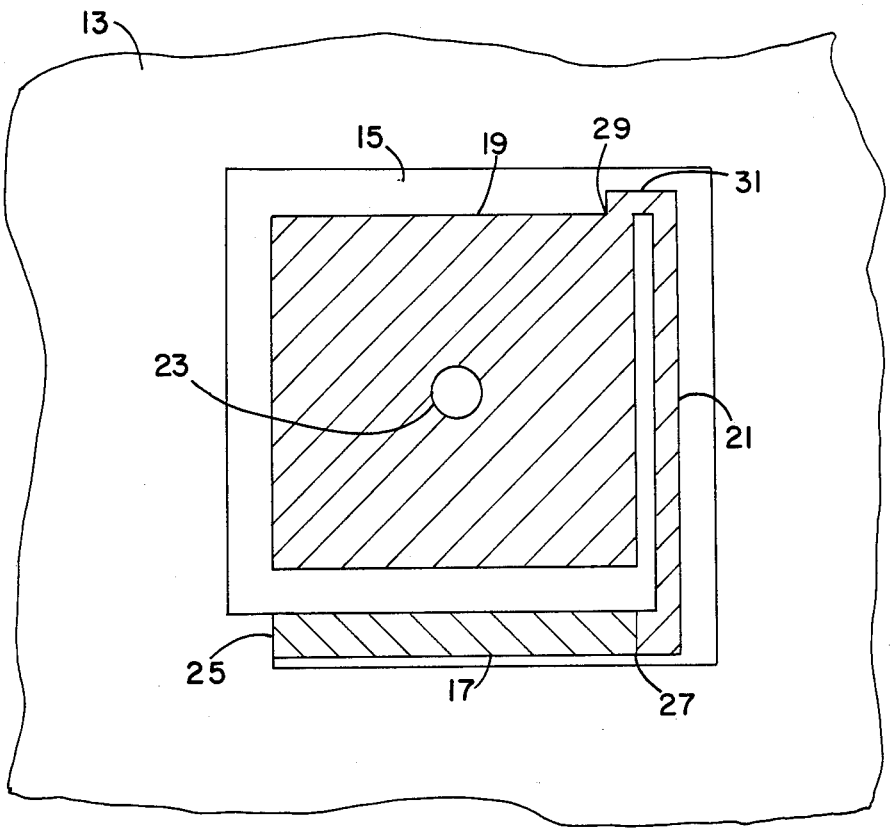
FIG. 1 shows a single element within the high density resistor array, shown in FIG. 2.

FIG. 1 shows a single element within the high density resistor array, according to the preferred embodiment. In particular, a part of the substrate, which may have a conductive or semi-conductive surface 13 mounted thereon, is shown surrounding a non-conductive area 15 on the same substrate. In the best mode of the invention, and according to the preferred embodiment, the surface 13 on the underlying substrate serves as a terminating surface connecting the terminating resistors in an ecl array. Such ecl arrays and the manner in which a terminating resistor is connected to each element in the array are well known and are not discussed in this specification. The substrate 13 may be conductive or semiconductive with the material removed therefrom, to form the non-conductive area 15 or the substrate itself may be conductive or semiconductive with a non-conductive area 15 placed on the conductive element 13. In the preferred embodiment, the substrate is non-conductive and the conductive surface serving as the terminating plane is selectively removed to expose a non-conductive area 15. However, it should be understood that the use of the plane 13 may be otherwise than a terminating plain, the preferred embodiment being shown by way of example only. Located within this non-conductive area 15 is a conductive surface shown as 19. The conductive surface has an opening 23 for receiving the pin connection to one of the elements in an array, for example an emitter coupled logic array. The pin, (not shown) inserted through the opening 23 which serves as a means for receiving and for connecting an electrical conductive part, then serves to connect the pin element in the array to the conductive surface 19.

As stated above, one of the objects of the invention is to provide a means for connecting one element among many in a high density array, to a terminating resistor while maintaining the impedances of the elements uniform. Accordingly, a terminating resistor 17 is shown connected to the terminating plane 13, at a first end 25 and to a leg 21 at its second end 27. The leg 21 is connected to the second end of the resistor 17 at the leg's first end shown as connection 27. The leg is the connected to the conductive surface at its second end, shown as connection 29 to the conductive surface 19. The conductive surface 19 has a perimeter, and as can be seen, the leg 21, at its second end, is connected to a point on the perimeter of the conductive surface 19 at location 29 and is located in the non-conductive area 15. When a circuit elements is connected, through a pin connection for example, to the conductive surface 19 through the means for receiving and for making the electrical connection, shown as 23, a path is created from that conductive surface 19 through leg 21 to resistor 17 and to the plane 13, which then serves as a terminating surface in the preferred embodiment.

As can be seen, the perimeter of the conductive surface 19 and the leg 21 and the resistor 17 are isolated from the plane 13; except for the series connection through the resistor 17 at location 25, by the non-conductive area 15. Further, as can be seen, the leg 21 has a length which is substantially longer than the width of the connecting point 29 of said leg 21 to the perimeter of the conductive surface 19. As can be seen, the cross section of the leg 21, is substantially that of the point connection of the conductive surface 19, to the leg 21, at location 29 and the length of the leg is substantially longer than its cross section. To increase the leg length and the advantages of this invention while maintaining it in the space available within the non-conductive area 15, the leg 21 includes a hook 31, which causes the circuit path from the conductive surface 19 to pass through three directions changes and thereby increases the length of leg 21.

The resistor 17 also is located in the non-conductive area 15 and is isolated from the means 23 for receiving the electrical part. In this way, the conductive distance, as well as the spacial distance from any pin inserted through the means 23, for receiving 3 and the heat generated when soldering, for example, a pin to conductive surface 19, can be isolated from the resistor 17, thereby diminishing any damage cause by that soldering heat. Further, the placement of resistor 17 within the isolated area, allows further space for the dissipation of the heat from the resistor.

According to the preferred embodiment, the conductive surface 19, is shown substantially to be that of a square and a regular geometric shape. However, it will be understood that the shape of the planar conductive surface, as the shape of the leg 21, hook 31, and the resistor 17, can be altered without varying from the principles of the invention.

Figure 2:
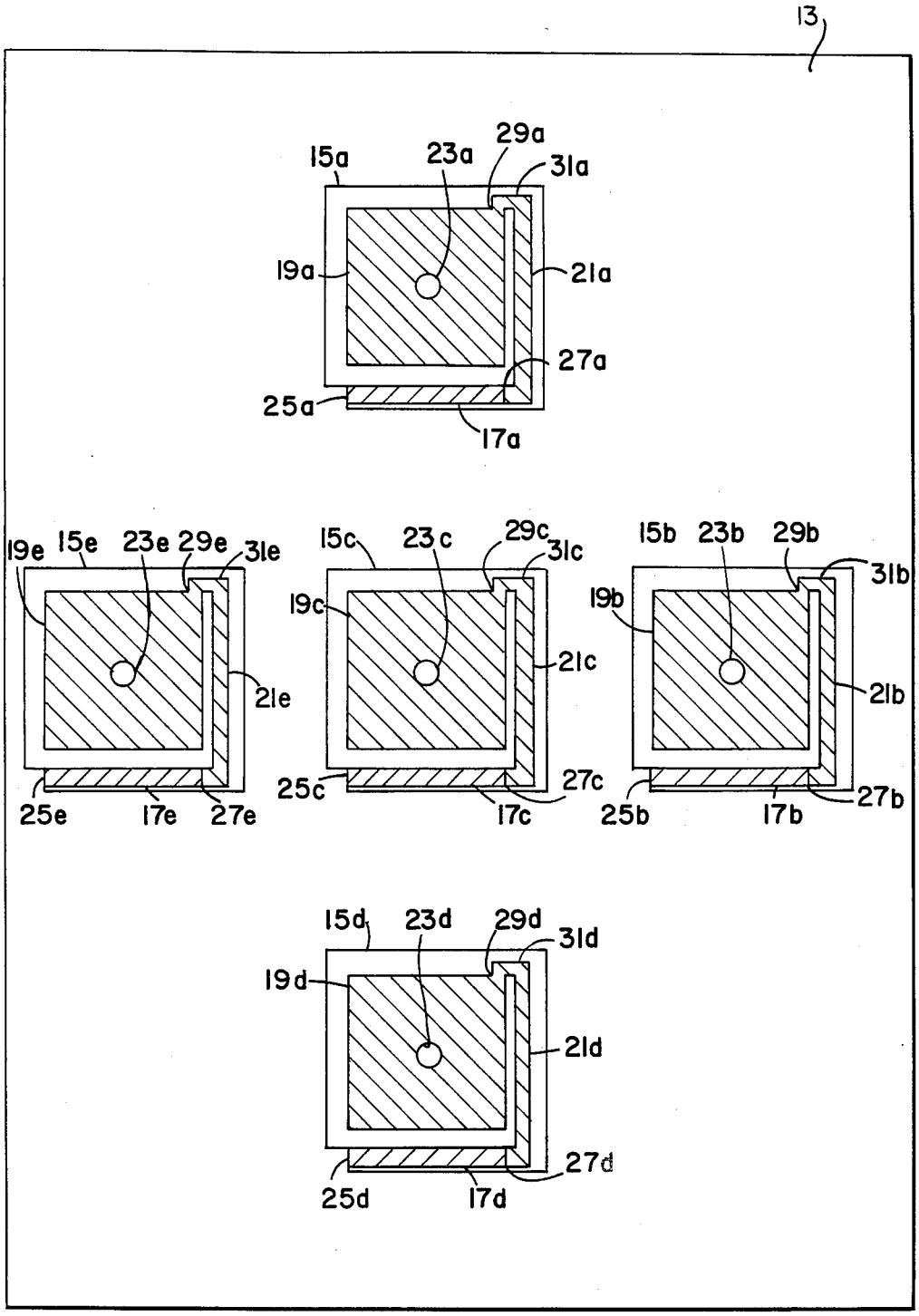
FIG. 2 shows a high density resistor array comprising a number of the single elements shown in FIG. 1.

The high density resistor array is shown in FIG. 2 as comprised of a number of the single elements, as shown in FIG. 1. In the disclosure, five such single elements, shown, for example, as 15*a* through 15*e* are disclosed, however, it should be understood that the array could be expanded without limitation. In the preferred embodyment, the center to center distances of each of the single elements is 100 mils. The center to center distances may be measured, for example, between the orthogonally located adjacent openings, 23*a –e* for receiving a pin connection, for example, to respective ones of the single elements in the array. As shown in FIG. 2, each of the single elements in the array are substantially identical wiht corresponding parts having the same numerals for each the single element, shown in FIG. 1 and with the same respective parts for each single element distringuished by the letters a–e.

According to the preferred embodiment, the point connections 29*a–e* of the legs 21*a–e* to the conductive surface 15*a–e* is less than 10% of the perimeter of the conductive surface 15*a–e*. Additionally, in the preferred embodiment and according to the best mode, the length of the leg 21*a–e* is less than 25% of the length of the perimeter surrounding the respective conductive surface 19*a–e*.

However, it should be understood that the dimensions disclosed above can be varied without departing from the invention concepts shown and disclosed.

Accordingly, what has been shown is a manner of constructing a high density array, which can be located on the circuit board and is capable of receiving for connection into respective single elements in the array, a pin connection to a circuit such as a transistor, for example. Additionally, what has been shown has been the ability to make that afore said connection while providing a uniform impedance into a terminating resistor and on to a plane, and spacially separating that resistor from the heat generated during the connection of that pin and providing isolation to the resistor allowing heat disipation therefrom during operation of the circuit, such as a transistor, for example.

In the description of the preferred embodiment, the preferred dimensions were shown as locating each of the single elements on a 100 mil. centers, althouth as stated above, that dimension may be varied without departing from the invention disclosed herein. Additionally, the shape of the leg may be extended or shortened, for example, by increasing or decreasing the number of directional changes in hook 31 of leg 21, through the conductive aea 15, or the cross sectional area of the connection of the leg 21, to the conductive surface 19, may be increased or decreased to occupy a wider or narrow extent of the conductive surface perimeter. Additionally, as would be apparent to those skilled in the art, the conductive surface can be increased or decreased, whereby either decreasing or increasing the non-conductive surface available to isolate the resistor 17 and which would then effect the amount of heat capable of dissipation by the resistance 17 in accordance with the requirement of the circuit elements connected to the high density array. For example, if the circuit elements required the resistors carry a greater current load to the plane 13, then the dissipation requirements of the resistor 17, would be increased, requiring a larger resistor and a more increased spacing of the resistor from the conductive area. Further, as would be apparent to one skilled in the art, if the connection of the circuit elements, through the respective means 23, described as a means for receiving and connection, required more heat, then the point of connection 29, of the leg 21, to the conductive surface 19, would need to be decreased and the length of leg 21, would be increased, possibly by increasing the number of directional turns and the length of the hook, shown as 31, to increase the separation of the resistance from the heat generating soldering process and to avoid damage of the resistor from the soldering process.

We claim:

1. An array element for an high density resistor array on a terminating surface including:

(a) a non-conductive area on said terminating surface, (b) in said non-conductive area, a conductive surface and a resistor (c) said resistor having first and second ends and being connected to said terminating surface at said first end of said resistor, (d) a leg, said leg being, connected to a point on the perimeter of said conductive surface, at a first end of said leg and with a second end of said leg connected to said second end of said resistor, (e) said leg being located in said non-conductive area.

2. The said array element of said high density resistor array of claim 1, wherein:

(f) said conductive surface being connected to said terminating surface through the said connection of said leg and said resistor.

3. The said array element of said high density resistor array of claim 3, wherein (g) said point is located on the perimeter of said conductive surface and said perimeter is isolated from said terminating surface by said non-conductive area.

4. The said array elements of said high density resistor array of claim 4, wherein (h) the perimeter of said conductive surface is substantially longer then the said point on said perimeter.

5. The said array element of said high density resistor array of claim 4, wherein (i) said leg has a length substantially longer then the said point on said perimeter.

6. The said array element of said high density resistor array of claim 4 wherein (j) said leg has a cross section substantially that of said point and said leg length is substantially larger than said cross section of said leg.

7. The said array elemlent of said high density resistor array of claim 6 wherein (k) said conductive surface is of a regular geometric shape, (l) said leg is arranged in a series of directional turns to extend the length of said leg on the said non-conductive area.

8. The said array element of said high density resistor array of claim 7 wherein (m) said resistor is a planar resistor mounted on said substrate and (n) said conductive surface has a means for receiving an electrical part.

9. The high density resistor array of claim 8 wherein:

(o) said electrical conductive part is a pin.

10. The high density resistor array of claim 9 wherein said point is less than ten percent (10%) of said perimeter.

11. The high density resistor array of claim 10 wherein said leg length is more than twenty-five percent (25%) of said perimeter.

12. The high density resistor array of claim 7 wherein said non-conductive area is substantially rectangular and said leg is coextensive with at least three sides of said non-conductive area.

13. The high density array of claim 9 wherein said conductive surface is substantially rectangular and said leg is coextensive with at least three sides of said conductive surface.

14. The high density array of claim 1 wherein said conductive surface has a means for receiving an electrical part, said electrical part is a connection to a circuit element.

15. The high density array of claim 14 wherein said circuit element is part of a balanced array.

16. The high density array of claim 13, wherein said array elements are substantially arranged apart from each other on a minimum of 100 mil. centers.

17. A high density resistor array on a terminating surface having a plurality of separated array elements placed on said terminating surface, including:

(q) a plurality of non-conductive area on said terminating surface, (r) in each said non-conductive area, a conductive surface and the resistor, (s) said resistor having first and second ends and being connected to said terminating surface at said first end of said resistor, (t) a leg, said leg being, connected to a point on the perimeter of said conductive surface, at a first end of said leg and with a second end of said leg connected to said second end of said resistor, (u) said leg being located in said non-conductive area.

18. The said array element of said high density resistor array of claim 1, wherein:

(v) said conductive surface being connected to said terminating surface through the said connection of said leg and said resistor.

19. The high density array of claim 17 including means for receiving an electrical part for connection to a circuit element.

20. The high density resistor array of claim 17, wherein said array elements are substantially on a minimum of 100 mil. centers.

* * * * *